United States Patent [19]

Harden

[11] 4,163,138

[45] Jul. 31, 1979

[54] FLUSH LIGHTED FLAT KEYBOARD ASSEMBLY

[75] Inventor: Phillip L. Harden, Roanoke, Ind.

[73] Assignee: Bowmar Instrument Corporation, Fort Wayne, Ind.

[21] Appl. No.: 887,742

[22] Filed: Mar. 17, 1978

[51] Int. Cl.[2] ..... H01H 09/02

[52] U.S. Cl. ..... 200/310; 200/5 A; 200/317

[58] Field of Search ..... 200/308, 310, 317, 5 A

[56] References Cited

U.S. PATENT DOCUMENTS

| | | | |
|---|---|---|---|
| Re. 29,440 | 10/1977 | Durkee | 200/5 A |
| 3,701,869 | 10/1972 | Jacole | 200/308 |
| 3,777,222 | 12/1973 | Harris | 200/317 |
| 3,811,025 | 5/1974 | Rach | 200/317 |
| 4,056,699 | 11/1977 | Jordan | 200/5 A |
| 4,060,703 | 11/1977 | Everett | 200/317 |
| 4,071,718 | 1/1978 | Harden | 200/308 |

OTHER PUBLICATIONS

IBM Technical Disclosure Bulletin, vol. 19, No. 2, Jul. 1976, Tille, "Control Panel, " by Promir & Wilzbach

*Primary Examiner*—Herbert F. Ross

*Attorney, Agent, or Firm*—Gust, Irish, Jeffers & Rickert

[57] ABSTRACT

A flush lighted flat keyboard assembly including a printed circuit board having conductors on one side. Resilient dome switch elements are supported on the one side of the board in spaced-apart relationship in peripheral contact with certain conductors to make center contact with other conductors upon the application of force thereon. Another printed circuit board has one side in facing relationship with the first board and has openings therein respectively in alignment with the switch elements. Light sources are mounted on the other side of the second board which has conductors thereon connected to energize the light sources. A flexible switch-actuating member has one side in facing relationship with the other side of the second board and has switch-actuating projections extending therefrom through the second board openings toward the switch elements. The one side of the actuating member also has isolator projections thereon intermediate the switch-actuating projections, which extend toward the second board. A flexible, flat keyboard member has one side abutting the other side of the actuator member. The actuator member is formed of light-transmissive material and selected areas of the keyboard member are light-transmissive so as to be selectively illuminated by the light sources.

15 Claims, 9 Drawing Figures

FLUSH LIGHTED FLAT KEYBOARD ASSEMBLY

BACKGROUND OF THE INVENTION

1. Field of the Invention

This invention relates generally to keyboard assemblies, and more particularly to a flush lighted flat keyboard assembly.

2. Description of the Prior Art

Keyboard assemblies of the type employed in electronic calculators and for digital control of appliances such as microwave ovens and television receivers, commonly comprise an array of momentary-contact switches mounted on a printed circuit board. Conventional keyboards employ individual push buttons at each key station which are contained by an escutcheon plate, each keytop protruding through an opening in the escutcheon to allow sufficient travel for switch actuation when pressure is applied. U.S. Pat. No. RE 29,440, assigned to the assignee of the present invention, discloses such a keyboard assembly.

In order to insure operation of the conventional keyboard over a wide temperature range, adequate clearance must exist between the keytops and the escutcheon in order to compensate for dissimilar coefficients of thermal expansion and contraction; however, with such clearance, the device becomes susceptible to contamination by moisture, sand, dust, etc. which may prevent reliable switch actuation. Conventional keyboards are also vulnerable to vibration and shock; normal reliable operation requires nearly a free-floating keytop which may become abraded by the escutcheon in response to shock or vibration, the process being accelerated at the resonant frequency of the key mass. Shock or vibration can also cause damage or destruction to sensitive switching elements beneath the key. Form-fitting boots have been tried to protect the keytops from moisture, sand, dust, etc.; however, such boots must be flexible to allow acceptable operational perforance and thus, offer little improvement with respect to shock and vibration.

In order to eliminate the problems above-described, flat keyboard assemblies have been proposed in which the push buttons are replaced by a relatively thin, flexible member having one side in facing relationship with the switch elements so that deflection of the member in a particular area in response to force manually exerted on the other side of the member actuates a respective switch element. U.S. Pat. No. 4,071,718 to the present inventor and also assigned to the assignee of the present application, discloses a flat keyboard assembly incorporating a flexible switch-actuated member between the flat keyboard member and the switch elements, the switch-actuating member having switch-actuating projections thereon respectively in alignment with the switch elements and isolating projections intermediate the switch-actuating projections which inhibit false actuation of another switch element when force is exerted on the keyboard member at a particular location associated with a particular switch element.

There are applications for flat keyboard assemblies in which it is desirable to provide lighting at all or selected ones of the key stations. For example, it may be desirable to illuminate all of the key stations for night operation or, it may be desirable to illuminate a particular key station in response to actuation thereof. Further, in certain computer-associated applications, it is desirable to provide a programmable keyboard assembly wherein the indicia for a particular key station may be changed in accordance with a computer program. Such an application requires selective alpha-numeric illumination of particular key stations.

SUMMARY OF THE INVENTION

The invention, in its broader aspects, provides a flush lighted flat keyboard assembly including a support member having flat opposite sides with at least two spaced switches on one side thereof, each including a resilient, metallic, momentary-contact switch element selectively actuable from a first to a second position in response to force exerted thereon. A flexible switch actuator member is provided having flat opposite sides with one side thereof in facing relationship with one side of the support member and switch elements, the one side of the actuator member having at least two spaced switch-actuating projections thereon respectively extending toward and in alignment with the switch elements. A flexible keyboard member is provided having flat opposite sides, one side of the keyboard member abutting the other side of the actuator member so that force exerted on the keyboard member in general alignment with a switch element deflects the keyboard member and actuator member thereby causing a projection to apply actuating force on the respective switch element. At least one light source is provided with means for mounting the same adjacent the one side of the actuator member and between the projections. Connectors are provided connected to the light source for energizing the same. The actuating member is formed of light-transmitting material, and at least one selected area of the keyboard member is light transmissive so as to be illuminated by the light source. Means are provided for maintaining the support member and keyboard member in assembled relation.

In one embodiment of the invention, the light source comprises a matrix of selectively energizable light-emitting elements to provide an alpha-numeric display.

It is accordingly an object of the invention to provide a flush lighted, flat keyboard assembly.

Another object of the invention is to provide a flush lighted flat keyboard assembly providing alpha-numeric illumination of a key station.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
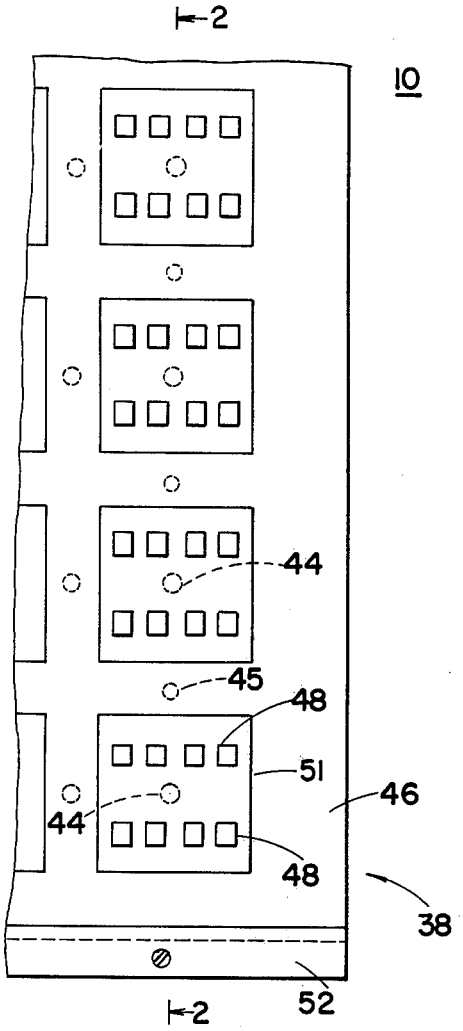
FIG. 1 is a fragmentary top view showing a portion of a programmable keyboard assembly having an alpha-numeric display associated with each key station.
Figure 3:
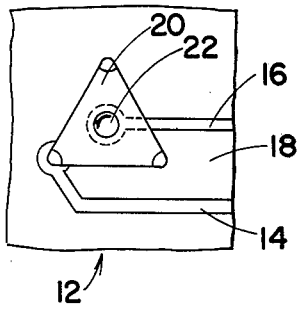
FIG. 3 is a fragmentary top view showing the underlying printed circuit board and one switch element.

Referring now to FIGS. 1 through 4 of the drawings, a flush lighted, flat, programmable keyboard assembly is shown, generally indicated at 10, comprising a rigid printed circuit board or support member 12 formed of suitable insulating material and having conductors 14, 16 (FIG. 3) on side 18 thereof. Resilient, metallic dome switch elements 20 are supported on side 18 of board 12 having peripheral engagement with certain conductors 14 and center contact areas 22 adapted to contact other conductors 16 upon the application of force exerted thereon. Board 12 and switch elements 20 may be of the type illustrated and described in said U.S. Pat. No. RE 29,440, or may be of any other conventional type. Sheet 24 formed of relatively thin insulating material, such as Mylar, and having pressure-sensitive adhesive on its side 26 is adhered to side 18 of board 12 and covers conductors 14, 16 and switch elements 20.

Another rigid printed circuit board or support member 28 formed of suitable insulating material has its side 29 in spaced, facing relationship with side 18 of board 12, insulating sheet 24 and switch elements 20. Openings 30 are formed through board 28 respectively in alignment with center contact areas 22 of switches 20. Switch actuating plate 32 is provided formed of suitable flexible, semi-rigid material, such as acrylic, having its side 34 in spaced, facing relationship with side 36 of board 28. Actuator plate 32 is preferably transparent. Keyboard member 38 formed of suitable flexible semi-rigid material has its side 40 abutting side 42 of actuating plate 32.

Actuator plate 32 has switch-actuating projections 44 extending from side 34 thereof through openings 30 in board 28 toward and in alignment with center contact areas 22 of switch elements 20. It will now be seen that application of force on top surface 46 of keyboard member 38 in the region aligned with a particular switch-actuating projection 44 and a switch element 20 will result in deflection of keyboard member 38 and actuator plate 32 so that the respective switch-actuating projection 44 will apply force on the respective switch 20. Isolator projections 45 are also formed on side 34 of actuator plate 32 intermediate switch-actuating projections 44, isolator projections 45 extending toward and engaging side 36 of board 28 so that force exerted in any particular area of side 40 of keyboard member 38 aligned with a particular switch 20 will not result in the application of force and actuation of another switch 20.

Figure 4:
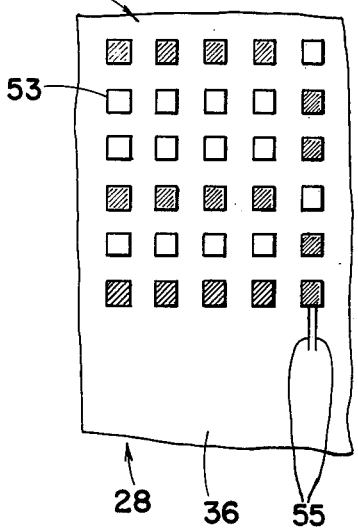
FIG. 4 is a fragmentary top view showing one dot matrix element of the alpha-numeric display associated with one key station.
Figure 2:
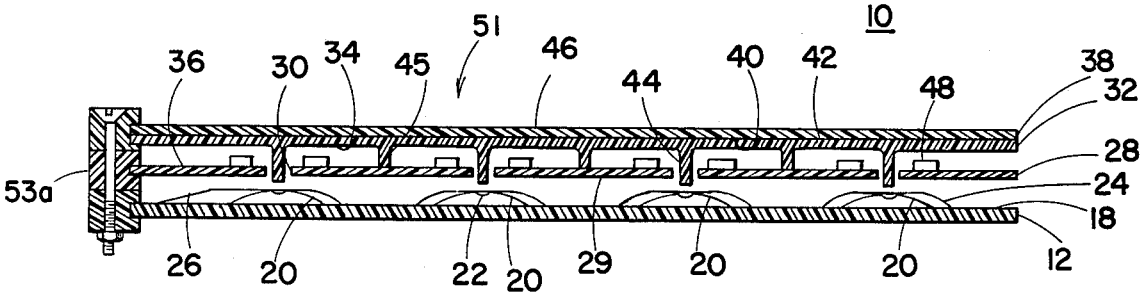
FIG. 2 is a cross-sectional view taken generally along the line 2—2 of FIG. 1.

In this embodiment, a plurality, shown here as being eight (8) matrices 48 of light-emitting elements or light sources, such as light-emitting diodes (LED's) is associated with each key station 51 and the associated switch element 20, and are mounted on side 36 of board 28, there being four (4) LED's 48 disposed in a line on one side of a respective opening 30 of board 28 and switch-actuating projection 44, the remaining four (4) matrices 48 being disposed in a parallel line on the other side of the respective opening 30 and projection 44. The board or support member 28 constitutes means for mounting the light source 48. Referring particularly to FIG. 4, each matrix 48 comprises a five (5) by seven (7) array of LED's 53. Conductors 55 on side 36 of board 28 are connected to LED's 50 to energize and thus illuminate the same. Matrix 48 shown in FIG. 4, shown with LED's 53 selectively energized to display the numeral three (3), it being understood that selective energization of LED's 53 will provide the desired alpha-numeric display.

In this embodiment, the area of side 46 of keyboard member 38 surrounding each key station 51 is preferably opaque and the area within each key station 51 is transparent to provide a window exposing the respective dot matrix 48.

Board 12 with switch elements 20, conductors 14, 16 and insulative sheet 24 thereon, board 28 with dot matrices 48 and conductors 55 thereon, actuator plate 32 and keyboard members 38 are held in assembled relationship by a suitable clamp 53*a*.

Figure 5:
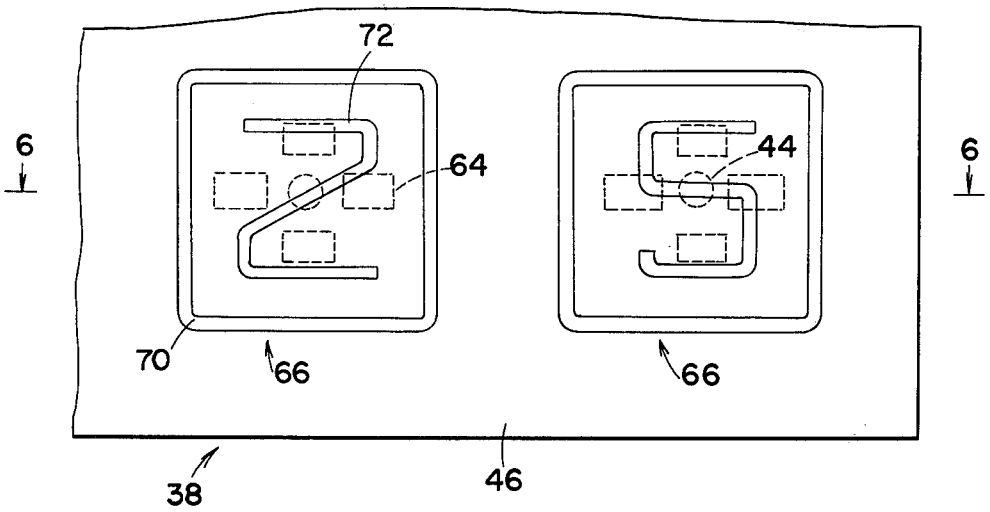
FIG. 5 is a fragmentary top view showing another embodiment of the invention providing illumination of fixed indicia of each key station.

Referring now to FIG. 5 of the drawings in which like elements are indicated by like reference numerals and similar elements by primed reference numerals, there is shown an embodiment of the invention, generally indicated at 54, which provides flush illumination of a flat keyboard having fixed indicia thereon. Here, printed circuit board 28′ of suitable insulating material and preferably thinner than printed circuit board 28 of the previous embodiment, is again positioned with its side 29′ overlaying and facing insulative sheet 24, switch elements 20 and side 18 of printed circuit board 12. Board 28′ has openings 30 therethrough respectively aligned with center contact areas 22 of switch elements 20.

Another member 56 is provided formed of suitable transparent insulative material having side 58 abutting side 36 of printed circuit board 28. Member 56 has openings 60 formed therethrough aligned with openings 30 in board 28′. Board 28′ and member 56 form a rigid subassembly.

Actuator plate 32′, again formed of transparent, flexible, semi-rigid material, has its side 34′ facing and normally spaced from side 62 of member 56. Actuator plate 32′ has switch-actuating projections 44′ extending through openings 60 in member 56 and openings 30 in printed circuit board 28′. The provision of member 56 eliminates the need for isolator projections 45 of the previous embodiment. Keyboard member 38 has its side 40 abutting side 42 of actuator plate 32′.

In this embodiment, a plurality of cavities 64, shown here as being four (4) in number, are formed in side 58 of member 56 at each key station 66 surrounding the respective openings 60, 30 in member 56 and board 28′. Miniature incandescent lamps 68 are respectively disposed in cavities 64 and are respectively energized by conductors 52 (FIG. 4) on surface 36′ of board 28′.

In this embodiment, the area surrounding each key station 66 again is preferably opaque and each key station is preferably surrounded or outlined by a transparent or translucent border 70. Indicia 72 are preferably transparent or translucent and the area of upper surface 46 of keyboard member 38 within each border 70 and which defines each indicia 72 is also preferably opaque.

Figure 6:
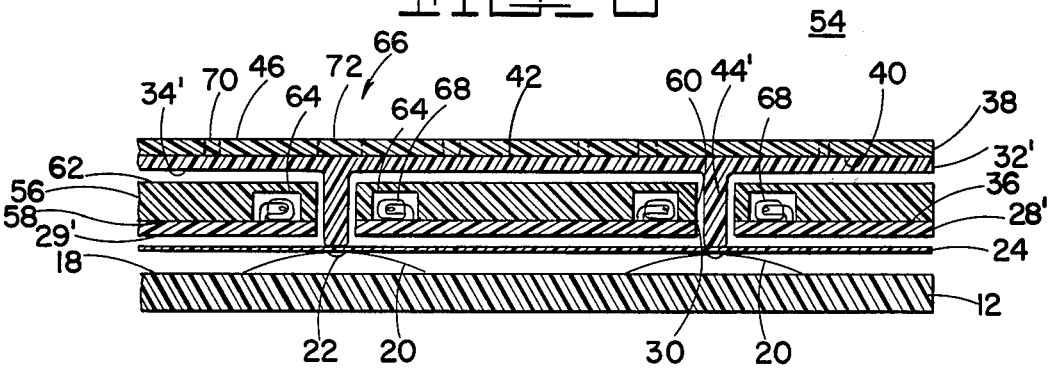
FIG. 6 is a cross-sectional view taken generally along the line 6—6 of FIG. 5.
Figure 7:
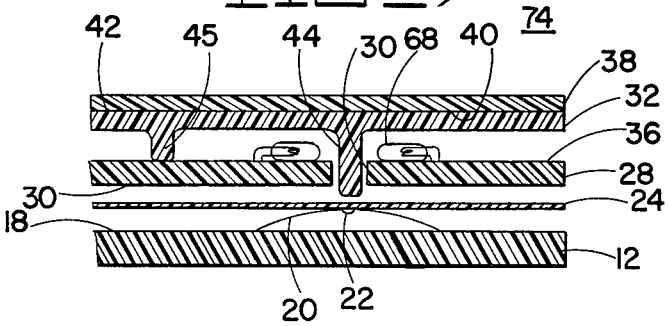
FIG. 7 is a fragmentary cross-sectional view showing a modification of the embodiment of FIGS. 5 and 6.

Referring now to FIG. 7 in which like elements are again indicated by like reference numerals, an embodiment of the invention is shown, generally indicated at 74, similar to the embodiment of FIGS. 1 through 4; but having miniature incandescent lamps 68 mounted on side 36 of printed circuit board 28 for illuminating fixed indicia 72 at key stations 66 of the embodiment of FIGS. 5 and 6.

Figure 8:
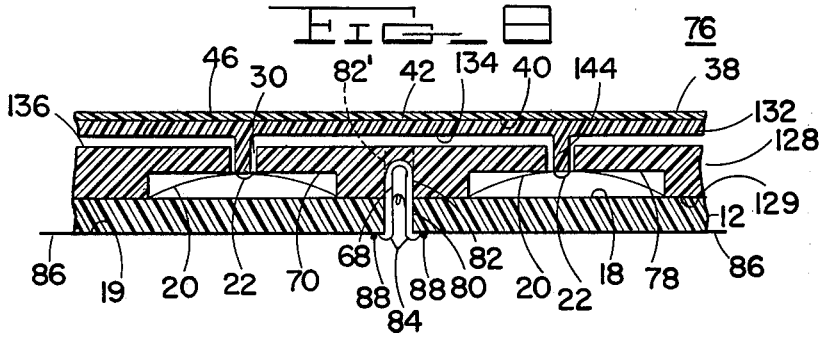
FIG. 8 is a fragmentary cross-sectional view showing yet another embodiment of the invention.

Referring now to FIG. 8 in which like elements are again indicated by like reference numerals, an embodiment of the invention is shown, generally indicated at 76, in which member 128 has side 129 abutting side 18 of printed circuit board 12 and the conductors thereon. Side 129 of member 128 has cavities 78 formed therein respectively accommodating switch elements 20.

Openings 30 are formed in member 128 respectively communicating with cavities 78 and in alignment with center contact areas 22 of switch elements 20. Actuator plate 132 has its side 134 spaced from side 136 of member 128 and has switch-actuating projections 144 formed on side 134 respectively extend through openings 30 in member 128 to actuate switch elements 20. Keyboard switch member 38 has its side 40 abutting side 42 of switch actuating plate 132.

Printed circuit board 12 has opening 82 formed therethrough intermediate switch elements 20, and member 128, which may be formed of light-transmissive insulating material, has cavity 82 formed in its side 129 in alignment with and communicating with opening 82. Lamp 68 is positioned in opening 82 in printed circuit board 12 and extends into cavity 82. Lamp 68 has its leads 84 connected for energization to conductors 86 on side 19 of printed circuit board 12, as by soldering at 88.

Switch actuating plate 132 again is preferrably formed of suitable flexible, semi-rigid, transparent plastic material, and keyboard member 38 is formed of suitable flexible, semi-rigid material with at least the indicia thereon aligned with switch elements 20 being light-transmissive.

In a slightly modified form of the embodiment shown in FIG. 8, cavity 82 may extend completely through member element 128, as indicated in dashed lines at 82' in FIG. 8, and in that event, member 128 need not be light-transmissive.

It will be seen that insulative sheet 24 of the previous embodiments is omitted in the embodiment of FIG. 8, switch elements 20 being retained in cavities 78 in member 128.

Figure 9:
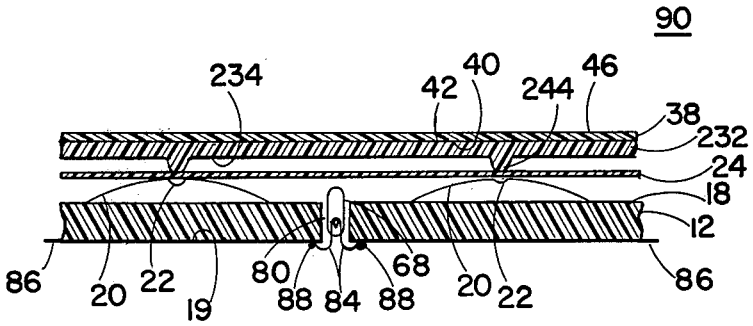
FIG. 9 is a fragmentary cross-sectional view showing a simplified version of the embodiment of FIG. 7.

Referring now to FIG. 9, in which like elements are still indicated by like reference numerals, there is shown an embodiment of the invention, generally indicated at 90, in which member 128 of the embodiment of FIG. 8 is eliminated and replaced by insulative sheet 24, which is light-transmissive in this embodiment. Here, projections 244 on side 234 of switch actuating plate 232 are respectively aligned with center contact areas 22 of switch elements 20 and actuate the same through insulative sheet 24. Opening 80 is formed in circuit board 12 between switch elements 20 and lamp 68 is positioned therein and is energized by its leads 84 connected to conductors 86 on side 19 of circuit board 12, as by soldering at 88.

It will now be seen that the invention provides a flush lighted, flat keyboard assembly suitable for use in a programable keyboard or for illuminating key stations having fixed indicia thereon.

While there have been described above the principles of this invention in connection with specific apparatus, it is to be clearly understood that this description is made only by way of example and not as a limitation to the scope of the invention.

What is claimed is:

1. In a flat keyboard assembly comprising a support member having flat opposite sides, at least two spaced switches on one side of said support member each including a resilient, metallic momentary-contact switch element selectively actuatable from a first to a second position in response to force exerted thereon, a flexible switch actuator member having flat opposite sides with one side thereof in spaced facing relationship with said one side of said support member and said switch elements, said one side of said actuator member having at least two switch-actuating projections thereon respectively extending toward and in alignment with said switch elements, and a flexible keyboard member having flat opposite sides, one side of said keyboard member abutting the other side of said actuator member whereby force exerted on said keyboard member in general alignment with a said switch element deflects said keyboard member and actuator member thereby causing a said projection to apply actuating force on the respective switch element, a light source; means for mounting said light source adjacent said one side of said actuator member in the space between said switches and said one side of said actuator member and between said projections; conductors connected to said light source for energizing the same; said actuator member being formed of light-transmissive material, at least one selected area of said keyboard member being light-transmissive thereby being illuminated by said light source; and means for maintaining said support member and keyboard member in assembled relation.

2. The assembly of claim 1 wherein said light source comprises a matrix of selectively energizable light-emitting elements thereby to provide an alpha-numeric display.

3. The assembly of claim 1 wherein said keyboard member has an opaque area surrounding said light-transmissive area, said light-transmissive area defining a selected indicia.

4. The assembly of claim 1 wherein said mounting means comprises another support member positioned between said first-named support member and said actuator member, said other support member having first and second flat opposite sides respectively facing and spaced from said one side of said first support member and said switch elements, and said one side of said actuator member, said other support member having at least two spaced openings formed therethrough, said switch-actuating projections respectively extending through said openings; said light source being mounted on said second side of said other support member; said conductors being on one side of said other support member.

5. The assembly of claim 4 wherein there is at least one light source adjacent each said other support member opening.

6. The assembly of claim 4 wherein there are at least two of said light sources respectively on opposite sides of each said other support member opening.

7. The assembly of claim 4 wherein there is a first group of a plurality of said light sources disposed in a line on one side of said other support member opening and a second group of a plurality of said light sources disposed in a line on the other side of said opening, said lines being parallel.

8. The assembly of claim 4 wherein said one side of said actuator member has at least one isolator projection intermediate said switch-actuating projections and extending toward said second side of said other support member whereby force exerted on said keyboard member in general alignment with one of said switch elements is isolated from other switch elements, there being at least two said light sources respectively intermediate said isolator projection and said switch-actuating projections.

9. The assembly of claim 4 wherein said support members are formed of rigid material.

10. The assembly of claim 4 further comprising a third member having first and second flat opposite sides, said first side of said third member abutting said second side of said other support member, said second side of said third member being spaced from said one side of said actuator member, said third member having at least two openings therethrough respectively aligned with said other support member openings and having said switch-actuating projections respectively extending therethrough, said third member having at least one cavity formed in said first side thereof with said light source being disposed therein, said third member being formed of light-transmissive material.

11. The assembly of claim 10 wherein said other support member and third member form a rigid sub-assembly, said first-named support member being formed of rigid material.

12. The assembly of claim 10 wherein there are a plurality of cavities formed in said first side of said third member surrounding each said opening, there being a plurality of said light sources respectively disposed in said cavities.

13. The assembly of claim 1 wherein said mounting means includes an opening therein, said light source being disposed in said opening, said conductors being on the other side of said support member.

14. The assembly of claim 13 further comprising another support member positioned between said first-named support member and said actuator member, said other support member having first and second opposite sides with said first side facing and spaced from said one side of said actuator member and said second side abutting said one side of said first-named support member, said second side of said other support member having cavities therein respectively accommodating said switch elements, said other support member having at least two openings formed therethrough respectively communicating with said cavities, said switch-actuating projections respectively extending through said openings, said other support member having another opening formed therein aligned with and communicating with said opening in said first-named support member, said light source extending into said other opening.

15. The assembly of claim 14 wherein said other opening is a cavity formed in said second side of said other support member, said other support member being formed of light-transmissive material.

* * * * *